US011434039B2

(12) United States Patent
Limousin et al.

(10) Patent No.: US 11,434,039 B2
(45) Date of Patent: Sep. 6, 2022

(54) FOLDABLE PACKAGE WITH SIMPLIFIED SHAPING

(71) Applicant: PA. COTTE SA, Pully (CH)

(72) Inventors: Damien Limousin, Saint Etienne de Montluc (FR); Ronan Affre De Saint Rome, Oudon (FR); Denis Mourrain, Vertou (FR); Pierre Blot, Nantes (FR)

(73) Assignee: PA. Cotte SA, Pully (CH)

( * ) Notice: Subject to any disclaimer, the term of this patent is extended or adjusted under 35 U.S.C. 154(b) by 0 days.

(21) Appl. No.: 17/429,173

(22) PCT Filed: Feb. 12, 2020

(86) PCT No.: PCT/EP2020/053582

§ 371 (c)(1),
(2) Date: Aug. 6, 2021

(87) PCT Pub. No.: WO2020/165241

PCT Pub. Date: Aug. 20, 2020

(65) Prior Publication Data

US 2022/0041322 A1 Feb. 10, 2022

(30) Foreign Application Priority Data

Feb. 15, 2019 (FR) ..... 1901563

(51) Int. Cl.
*B65D 5/20* (2006.01)
*B65D 5/00* (2006.01)
*B65D 25/10* (2006.01)

(52) U.S. Cl.
CPC ..... *B65D 5/2066* (2013.01); *B65D 5/0015* (2013.01); *B65D 25/102* (2013.01)

(58) Field of Classification Search
CPC .. B65D 5/2066; B65D 5/0015; B65D 25/102; B65D 5/5213; B65D 5/52
(Continued)

(56) References Cited

U.S. PATENT DOCUMENTS 2,550,968 A * 5/1951 Bussey ..... B65D 5/5213 206/740
2,680,512 A * 6/1954 Young ..... B65D 5/5213 206/755

(Continued)

OTHER PUBLICATIONS

International Search Report and Written Opinion issued by the International Searching Authority, dated Jun. 17, 2020, for International Patent Application No. PCT/EP2020/053582; 12 pages.

(Continued)

*Primary Examiner* — Christopher R Demeree
(74) *Attorney, Agent, or Firm* — Faegre Drinker Biddle & Reath LLP

(57) ABSTRACT

A package comprising a case defining a stowing volume, and a cover intended to close the stowing volume of the case, the case having a bottom and a peripheral rim which can adopt a stowed position in which it extends substantially parallel to the bottom and a use position in which it extends substantially perpendicular to the bottom. The case comprises a rigid element connected to the first panel and to the third panel by an elastic connection, the rigid element being movable between a storage position in which the rigid element is located near the bottom and a use position in which the rigid element is spaced from the bottom, the elastic connection tending to displace the rigid element from its storage position to its use position.

12 Claims, 7 Drawing Sheets

(58) Field of Classification Search
USPC ..... 229/117, 120.08, 146; 206/483, 250, 206/768; 40/124.08, 539
See application file for complete search history.

(56) References Cited

U.S. PATENT DOCUMENTS 3,311,283 A * 3/1967 Shimada ..... B65D 5/6688 229/125.08
5,682,999 A * 11/1997 Larson ..... A63H 3/18 206/45.28
5,865,334 A * 2/1999 Ruiz ..... B65D 85/48 220/6
6,467,624 B1 10/2002 Lofgren
7,296,681 B2 * 11/2007 McDonald ..... B65D 5/5021 206/521
8,627,958 B2 * 1/2014 McDonald ..... B65D 5/321 206/583
8,794,435 B1 * 8/2014 Marini ..... B65D 85/185 206/278
9,650,192 B2 * 5/2017 Schindler ..... B65D 71/0007
11,161,646 B1 * 11/2021 Parrish ..... B65D 5/5455
2005/0011807 A1 1/2005 Dennison
2008/0110788 A1 * 5/2008 Keiger ..... B65D 81/075 206/497
2015/0014404 A1 * 1/2015 Iwata ..... B65D 85/1054 229/160.1
2019/0092517 A1 * 3/2019 Chou ..... B65D 5/5213
2019/0092556 A1 * 3/2019 Chou ..... B65D 5/5213

OTHER PUBLICATIONS

English translation of the International Search Report and Written Opinion issued by the International Searching Authority, dated Jun. 17, 2020, for International Patent Application No. PCT/EP2020/053582; 2 pages.

* cited by examiner

FOLDABLE PACKAGE WITH SIMPLIFIED SHAPING

CROSS-REFERENCE TO RELATED APPLICATIONS

The present application is a national stage entry of International (PCT) Patent Application Number PCT/EP2020/053582, filed Feb. 12, 2020, which in turn claims priority to French Patent Application No. 1901563, filed Feb. 15, 2019, the subject matter of which are expressly incorporated herein by reference.

The field of the invention is that of logistics. More specifically, the invention relates to a package, also called a packaging means, that is to say a container, for conveying objects between two destinations.

To transport an object in safety, packages such as boxes made of plastic materials and cardboard boxes are known. In general, the packages comprise a case having a bottom and a peripheral rim which together define a stowing volume in which is housed at least one object to be transported.

The packages also comprise a cover which is movable relative to the case, or attached to the case, this cover being able in particular to adopt a closed position in which the cover closes the stowing volume of the case.

More particularly, the peripheral rim comprises:

a first panel;

a second panel;

a third panel opposite the first panel;

a fourth panel opposite the second panel.

Each panel can thus adopt:

a stowed position in which it extends substantially parallel to the bottom;

a use position in which it extends substantially perpendicular to the bottom.

To transport an object, a user grabs a package in a stowed position. Indeed, most often, the panels of the peripheral rim are in their stowed position, which implies that the package is in a flat configuration.

The user must then shape the case, that is to say define the stowing volume by positioning each of the panels of the peripheral rim in its use position.

For this purpose, the user does not need to resort to the use of tools and uses his hands to position each of the panels in its use position and, if necessary, secure the panels together in their use position.

To facilitate the shaping of the case, drive elements have been designed between the different panels.

Thus, by acting on several panels simultaneously, it is possible to position the panels on which the user is not acting in their use position thanks to the drive elements.

However, such systems have some drawbacks.

First, to ensure the correct shape of the case, the user is forced to position their hands in a certain way.

More specifically, the user cannot choose which panel he wishes to position in its use position but is forced, by the presence of the drive elements, to act on certain panels specifically.

The result is therefore a precise shaping sequence which the user cannot deviate from.

In the event of a deviation from this shaping sequence, the user may be forced to restart the shaping, since one or more of the panels of the case remain in their stowed position or in an intermediate position between the stowed position and the use position.

Moreover, such a system also requires acting with a predetermined force of the user.

Indeed, the drive elements are as small as possible and then require the user to force against them in order to transmit the movement of the panels on which he acts to the other non-actuated panels, so that the non-actuated panels adopt their use position.

Thus, a user may have difficulty shaping a case and not be able to shape it. Furthermore, the repeated movements and the force required for this repetition of movement can cause musculoskeletal problems for users.

Furthermore, the step of shaping the cases represents a significant waste of time, especially when there are a lot of cases to be shaped (which is the case in the field of logistics).

The purpose of the invention is in particular to overcome the drawbacks of the prior art.

More specifically, the purpose of the invention is to provide a package having a folding case, the shaping of which is facilitated compared to the prior art.

Also the purpose of the invention is to provide such a package, the case of which requires little force from the user for its shaping.

Furthermore, the purpose of the invention is to provide such a package, the case of which is quick to be shaped for a user.

These purposes, as well as others which will appear subsequently, are achieved thanks to the invention which relates to a package comprising a case defining a stowing volume, and a cover intended to close the stowing volume of the case, the case having a bottom and a peripheral rim comprising:

a first panel;

a second panel;

a third panel opposite the first panel;

a fourth panel opposite the second panel, each of the first panel, second panel, third panel and fourth panel can adopt:

a stowed position in which it extends substantially parallel to the bottom;

a use position in which it extends substantially perpendicular to the bottom;

characterized in that the case comprises a rigid element connected to the first panel and to the third panel by an elastic connection, the rigid element being movable between:

a storage position of the case corresponding to the stowed position of the panels of the peripheral rim, in which the rigid element is located near the bottom;

a use position of the case corresponding to the use position of the panels of the peripheral rim, in which the rigid element is spaced from the bottom, the elastic connection tending to displace the rigid element from its storage position to its use position.

Thanks to the elastic connection, the rigid element slides against the first panel and the second panel, causing them to move apart from each other.

In other words, the rigid element causes the first panel and the second panel to gradually move into their use position almost automatically thanks to the elastic connection.

For the user, the rigid element thus acts as an assistance in shaping the case.

Indeed, the invention contributes to:

reduce the package shaping time;

reduce the physical forces required to shape the package.

Advantageously, the case also comprises at least:

a first drive element interposed between the first panel and the second panel or the fourth panel of the peripheral rim;

a second drive element interposed between the third panel and the second panel or the fourth panel of the peripheral edge, The drive elements allow the second panel and the fourth panel to be positioned in their use position simultaneously with the first panel and the second panel.

It is therefore not necessary for the user to act directly on the second panel and the fourth panel.

Preferably, the rigid element is a plate of a length equal to the distance between the first panel and the third panel in their use position.

Such a length allows to guarantee, or nearly guarantee, the positioning of the first panel and the second panel in the use position. Indeed, when the rigid element is in its use position, that is to say spaced from the bottom of the case, it is near a free end of the first panel and of the second panel. Thus, the length allows to obtain a perpendicularity between the first panel and the bottom of the case as well as between the third panel and the bottom of the case.

According to a preferred embodiment, the elastic connection comprises at least one elastically deformable band or cable.

This elastic band or cable allows to tend to position the rigid element in its use position.

Preferably, the case also comprises means for retaining the first panel, the second panel, the third panel and the fourth panel in their use position.

Thus, the panels, and therefore the peripheral rim, are held in their use position, so as to facilitate the insertion of at least one object into the stowing volume by the user. Indeed, the user does not have to worry about holding the formed case and can freely position the object or objects in the stowing volume, and, more particularly, on the connecting rod.

In this case, the retaining means comprise two parts each permanently mounted on the peripheral rim of the case.

Such retaining means provide good reversibility. Indeed, retaining the panels in their use position is thus not definitive, and the user can fold the case effortlessly.

Advantageously, the cover comprises:

a first flap pivotally mounted on the first panel of the peripheral rim;

a second flap pivotally mounted on the third panel of the peripheral rim;

a third flap pivotally mounted on the second panel of the peripheral rim;

a fourth flap pivotally mounted on the fourth panel of the peripheral rim, each flap being movable between a closed position in which it prevents access to the stowing volume of the case, and an open position in which it leaves free access to the stowing volume of the case.

A multi-part cover allows the user to easily close the package by successive small movements, unlike large movements in the case of a one-piece cover.

Moreover, such a cover is less bulky than those with one or two flaps, so that this allows the package to be shaped even in a small space.

According to a first embodiment, in their closed position, the first flap and the second flap extend in the continuation of one another, and, the third flap and the fourth flap extend overlapping one another and overlapping the first flap and the second flap.

Such an arrangement of the flaps allows to guarantee a confinement of the objects transported in the package. Indeed, even by lifting the third or the fourth flap, the objects are confined in the stowing volume thanks to the first flap and the second flap.

According to a second embodiment, in their closed position, the third flap and the fourth flap extend in the continuation of one another, and, the first flap and the second flap extend overlapping one another and overlapping the third flap and the fourth flap.

Likewise, such an arrangement of the flaps allows to guarantee a confinement of the objects transported in the package since, even by lifting the third or the fourth flap, the objects are confined in the stowing volume thanks to the first flap and the second flap.

According to another advantageous embodiment, the first flap and the second flap, or the third flap and the fourth flap, which extend in the continuation of one another, each have an internal surface facing the stowing volume in their closed position, the internal surface being covered with a non-slip coating and/or a flexible material capable of being deformed by an object contained in the stowing volume.

The adherent coating also allows to limit, or even eliminate, the displacement of an object relative to the cover, in particular when handling the closed package, for example during transport. Then, this promotes the integrity of the object transported in the package.

The flexible material, that is to say elastically deformable, ensures the retention of the object or objects in the stowing volume so as to avoid their damage during transport.

Advantageously, the plate has a non-slip coating and/or a flexible material allowing the retention of an object in the stowing volume of the case.

The adherent coating also allows to limit, or even eliminate, the sliding of an object on the plate, in particular when handling the closed package, for example during transport. Then, this promotes the integrity of the object transported in the package.

The flexible material, that is to say elastically deformable, also ensures the retention of the object or objects in the stowing volume, and more specifically on the plate, so as to avoid their damage during transport.

Preferably, the package comprises a digital communication panel secured to one of the case panels or to the cover.

This digital communication panel allows the user to know the delivery information, for example displayed on a screen or a dynamic label, and to display in real time a modification of the delivery information.

Other features and advantages of the invention will emerge more clearly upon reading the following description of various preferred embodiments of the invention, given by way of illustrative and non-limiting examples, and the appended drawings, among which:

Figure 1:
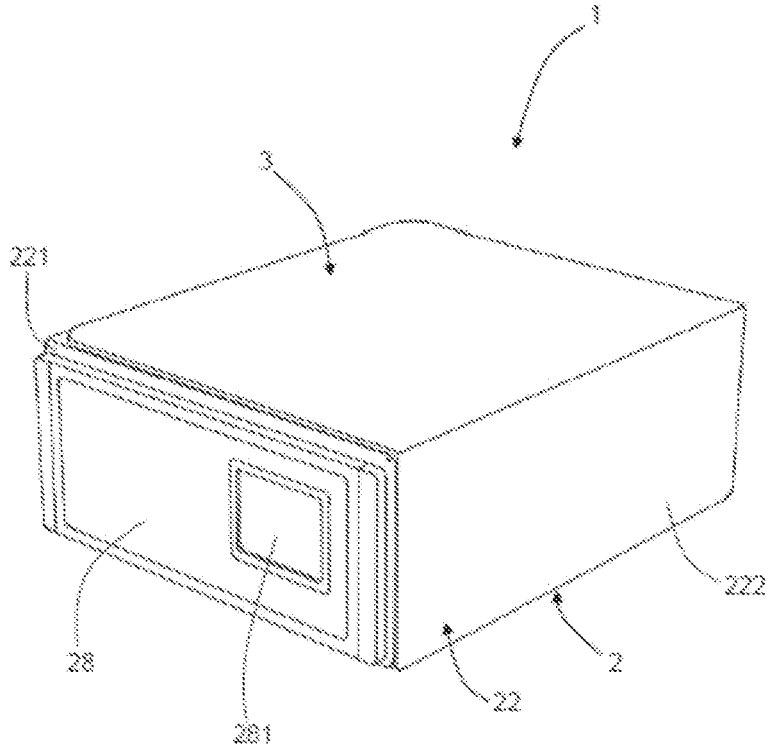
FIG. 1 is a perspective top view of a package according to the invention.

Referring to FIG. 1, a package 1 according to the invention is illustrated.

This package 1 comprises a case 2 defining a stowing volume and a cover 3 intended to close the stowing volume of the case 2.

The case 2 has in particular a bottom 21 and a peripheral rim 22 comprising:

a first panel 221;

a second panel 222;

a third panel 223 opposite the first panel 221;

a fourth panel 224 opposite the second panel 222.

Each of the first panel 221, the second panel 222, the third panel 223 and the fourth panel 224 is mounted movable relative to the bottom 21, that is to say, it can adopt:

a stowed position in which it extends substantially parallel to the bottom 21;

and a use position in which it extends substantially perpendicular to the bottom 21.

The case 2 also comprises at least one drive element 23 interposed between two panels 221, 222, 223, 224 to facilitate their simultaneous switching from their stowed position to their use position, and vice versa, as explained below.

Figure 2:
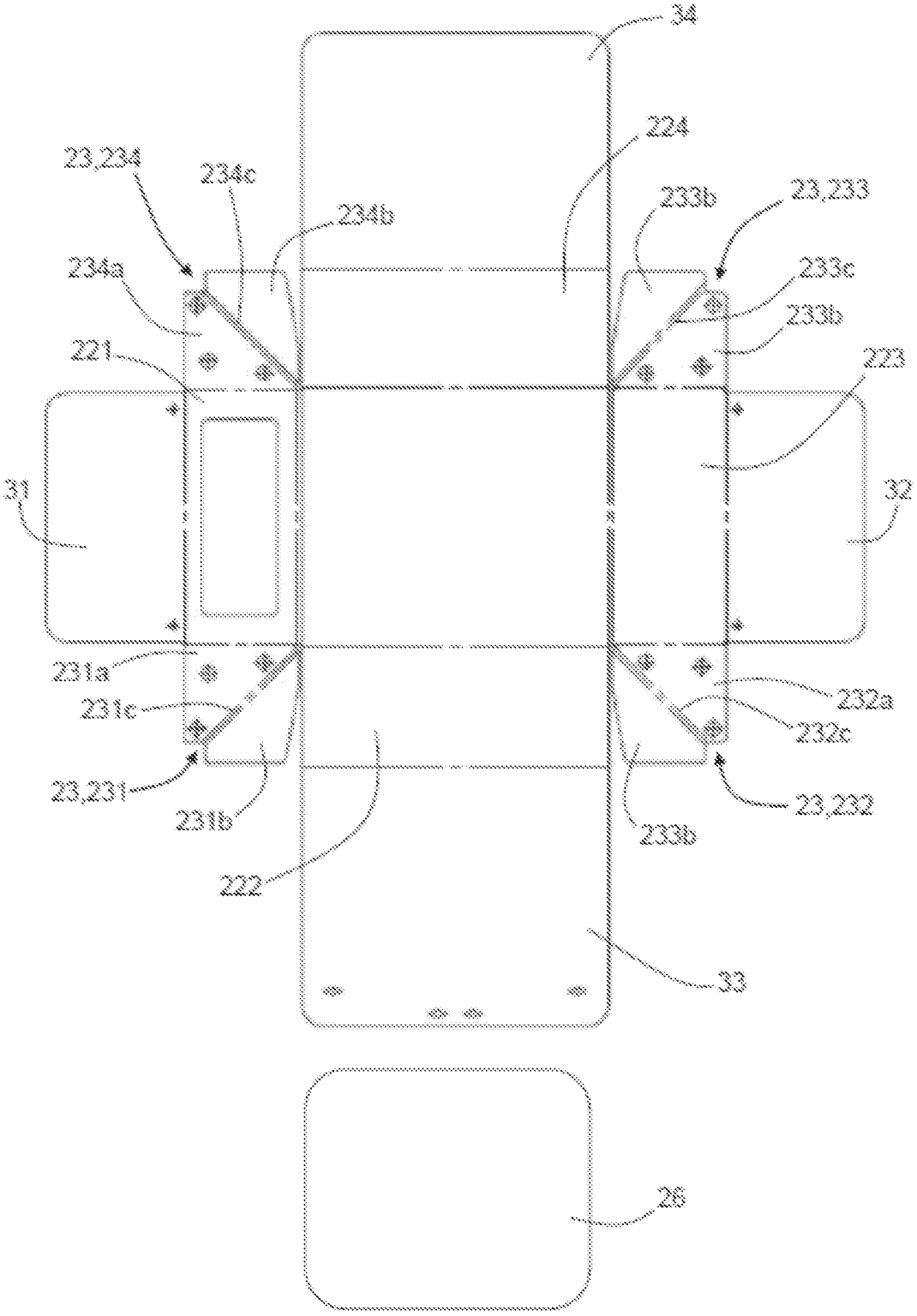
FIG. 2 is an exploded top view of a package according to the invention, in a flat configuration, that is to say that all the components of the package are located in the same plane.

More specifically, as illustrated in FIG. 2, the case 2 comprises:

a first drive element 231;

a second drive element 232;

a third drive element 233;

a fourth drive element 234.

More particularly, the first drive element 231 comprises a first portion 231*a* extending from the first panel 221 of the peripheral rim 22 and a second portion 231*b* pivoting relative to the first portion 231*a* by means of a hinge 231*c*. The second portion 231*b* of the first drive element is intended to be secured to the second panel 222 of the peripheral rim 22, for example by means of ultrasonic welds.

The second drive element 232 comprises a first portion 232*a* extending from the third panel 223 of the peripheral rim 22 and a second portion 232*b* pivoting relative to the first portion 232*a* by means of a hinge 232*c*. The second portion 232*b* of the second drive element is intended to be secured to the second panel 222 of the peripheral rim 22, for example by means of ultrasonic welds.

The third drive element 233 comprises a first portion 233*a* extending from the third panel 223 of the peripheral rim 22 and a second portion 233*b* pivoting relative to the first portion 233*a* by means of a hinge 233*c*. The second portion 233*b* of the third drive element 233 is intended to be secured to the fourth panel 224 of the peripheral rim 22, for example by means of ultrasonic welds.

Finally, the fourth drive element 234 comprises a first portion 234*a* extending from the first panel 221 of the peripheral rim 22 and a second portion 234*b* pivoting relative to the first portion 234*a* by means of a hinge 234*c*. The second portion 234*b* of the fourth drive element 234 is intended to be secured to the fourth panel 224 of the peripheral rim 22, for example by means of ultrasonic welds.

In order to hold the panels 221, 222, 223, 224 of the peripheral rim in their use position, the case 2 comprises means 25 for retaining the panels 221, 222, 223, 224 relative to each other.

More particularly, the retaining means 25 allow holding in the use position:

the first panel 221 relative to the second panel 222;

the second panel 222 relative to the third panel 223;

the third panel 223 relative to the fourth panel 224;

the fourth panel 224 relative to the first panel 221.

The retaining means 25 advantageously belong to the following groups:

magnetic retaining means;

insert;

deformable retaining means;

retaining means with bracing.

Preferably, the retaining means 25 comprise two parts each permanently mounted or each secured the peripheral rim 22 of the case 2, as explained below.

FIGS. 8 to 11 illustrate the different variants of retaining means.

Figure 8:
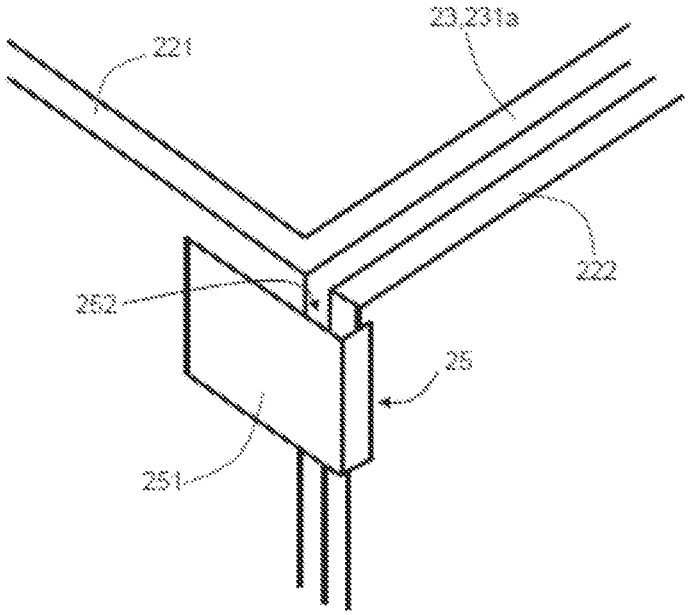
FIG. 8 is a schematic representation of the package panel retaining means according to the invention, according to a first embodiment.

FIG. 8 illustrates retaining means 25 by bracing or also called by interference.

More specifically, each of the second panel 222 and the fourth panel 224 comprises at least one hook 251 projecting towards the first panel 221 or the third panel 223.

Preferably, the hook 251 of the second panel 222 is oriented towards the first panel 221 and the hook 251 of the fourth panel 224 is oriented towards the third panel 223, or vice versa.

In other words, at least one hook 251 is intended to cooperate with the first panel 221 and another hook 251 is intended to cooperate with the third panel 223.

The hook 251 then forms a space 252 with a rim of the second panel 222 or of the fourth panel 224, this space 252 being intended to receive the first panel 221 or the third panel 223.

Each hook 251 is elastically deformable so that, when the first panel 221 and the third panel 223 are shaped, they elastically deform each hook 251 to contact the rim of the second panel 222 or of the fourth panel 224.

Each hook 251 then recovers its initial shape so as to hold the first panel 221 or the third panel 223 against the rim of the second panel 222 or of the fourth panel 224.

In a variant not shown, the retaining means 25 can be in the shape of tabs secured to the first panel 221 and the third panel 223. These tabs are intended to be housed in slots made in the second panel 222 and the fourth panel 224. The cooperation between the tabs and the slots is advantageously tight so that, when the tabs are inserted into the slots, it is necessary to exert a significant traction force on the first front panel 221 and on the third panel 223 to release the tabs from the slots.

Figure 9:
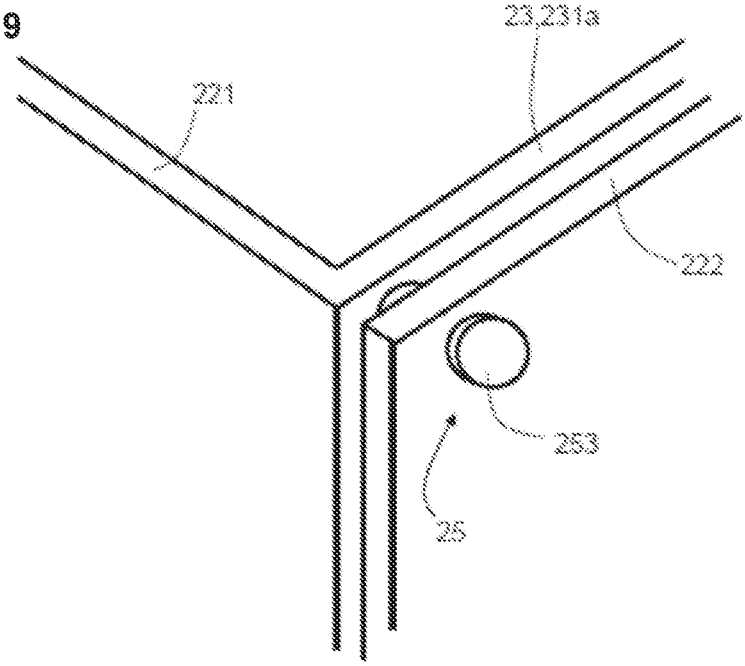
FIG. 9 is a schematic representation of the package panel retaining means according to the invention, according to a second embodiment.

FIG. 9 illustrates retaining means 225 by insert 253, that is to say by assembling two panels of the peripheral rim 22 using an insert 253.

More specifically, an insert 253, such as a pin or a stud, is inserted into openings made on each of the first panel 221, the second panel 222, the third panel 223, the fourth panel 224, and on each of the drive elements 23, more particularly on their first portion.

Furthermore, the insert 253 comprises a central portion intended to pass through the openings of the panels 221, 222, 223, 224, and of the drive elements, as well as two foldable stops, each located on either side of the central portion.

The shape of the peripheral rim 22 is then retained by inserting the central part of the inserts 253 into the openings of the panels 221, 222, 223 and 224 and of the drive elements 23, then folding the foldable stops so that the panels 221, 222, 223, 224 of the peripheral rim 22 and the drive elements 23 are sandwiched between the two foldable stops of the insert 253.

Figure 10:
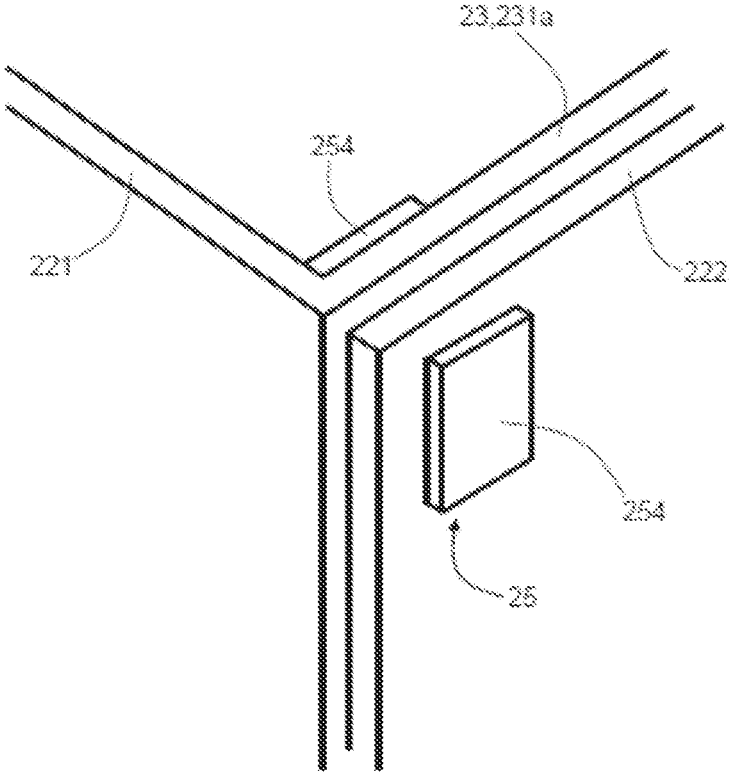
FIG. 10 is a schematic representation of the package panel retaining means according to the invention, according to a third embodiment.

FIG. 10 illustrates retaining means 25 by magnetism. For this purpose, each panel 221, 222, 223, 224 of the peripheral rim 22 is provided with a magnet 254.

Likewise, each of the drive elements 23, and more particularly their first portion, carries a magnet 254.

To enable their cooperation, the magnets 254 are mated in pairs with reversed polarity.

In other words, the magnets 254 of the panels 221, 222, 223, 224 have negative polarity and the magnets 254 of the drive elements 23 have positive polarity, or vice versa.

The magnets 254 which are located on the drive elements 23 are intended to cooperate with another opposite magnet 254 located on one of the panels 221, 222, 223, 224.

In the use position of the panels 221, 222, 223, 224 of the peripheral rim 22, the first portions of the drive elements are pressed against the second panel 222 or the fourth panel so that their respective magnets 254 can cooperate.

Figure 11:
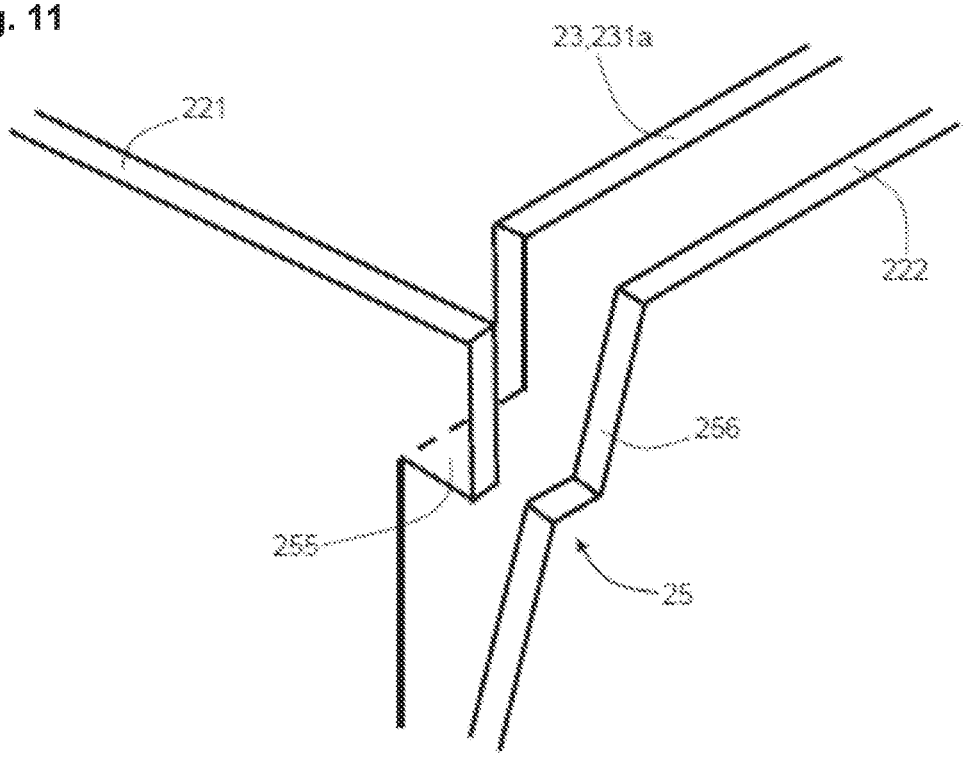
FIG. 11 is a schematic representation of the package panel retaining means according to the invention, according to a fourth embodiment.

FIG. 11 illustrates retaining means 225 by deformation.

The second panel 222 and the fourth panel 224 then have a projection 255 oriented towards the first panel 221 and the third panel 223.

The first panel 221 and the third panel 223 then have recesses 256 each intended to cooperate with a projection 255. The insertion of a projection 255 in a corresponding recess 256 then causes the elastic deformation of the projection 255 which, by seeking to recover its undeformed state, exerts a force on the recess 256. Then, this causes the panels 221, 222, 223, 224 to be held in position relative to each other, and therefore the peripheral rim 22 to be held in shape, that is to say perpendicular to the bottom 21.

Furthermore, the case 2 also comprises a rigid element 26 interposed between the first panel 221 and the third panel 223 of the peripheral rim 22.

The rigid element 26 is in the shape of a plate extending between the first panel 221 and the third panel 223 of the peripheral rim 22, and has a length equal to the distance between the first panel 221 and the third panel 223 in their use position.

The rigid element 26, that is to say the plate, is in particular connected to the cover or to the first panel 221 and to the third panel 223 via an elastic connection 27.

In the figures, the elastic connection is fixed to the cover 3.

The rigid element 26, that is to say the plate, is then movable in translation relative to the bottom 21 between two positions, namely:

a storage position of the case 21 corresponding to the stowed position of the panels 221, 222, 223, 224 of the peripheral rim 22, in which the rigid element 26 is located near the bottom 21;

a use position of the case 2 corresponding to the use position of the panels 221, 222, 223, 224 of the peripheral rim 22, in which the rigid element 26 is spaced from the bottom 21.

The elastic connection 27 thus forms means for returning the rigid element 26, that is to say the plate, to the use position.

The elastic connection 27 comprises at least one elastically deformable band or cable.

More specifically, as illustrated in the figures, the elastic connection is formed by an elastically deformable cable. The elastically deformable cable is fixed in a single part both to the first panel 221 of the peripheral rim 22 or first flap 31 of the cover 3, to the third panel 223 of the peripheral rim 22 or to the second flap 32 of the cover, and to the plate, that is to say to the rigid element 26.

The elastic cable then crosses the first panel 221 of the peripheral rim 22 or of the first flap 31 of the cover 3, then crosses the plate, extends along the plate, then crosses the plate again to cross in two places the third panel 223 of the peripheral rim 22 or the second flap 32 of the cover 3, crosses the plate again and extends along the latter to the first panel 221 of the peripheral rim 22 or to the first flap 31 of the cover 3 that it crosses again to be secured thereto or join and be secured to a first end of the elastically deformable cable.

The elastically deformable cable thus forms a coil crossing both the case 2 or the cover, and the plate.

Thus, in the use position of the panels 221, 222, 223, 224 of the peripheral rim 22, the elastic connection forms a member for returning the plate in its use position.

Thus, a force applied to the plate in the direction of the bottom 21 of the case 2 elastically deforms the elastically deformable cable so as to exert a traction effect of the first panel 221 and of the third panel 223 from the peripheral rim 22 towards the bottom 21 of the case 2.

The means 25 for retaining the panels 221, 222, 223, 224 in the use position allow to prevent the panels 221, 222, 223, 224 from recovering their stowed position.

The rigid element 26, that is to say the plate, has an upper surface intended to be opposite the cover 3 when the latter closes the stowing volume, this upper surface carries a non-slip coating and/or a flexible material allowing the retention of an object in the stowing volume of the case 2.

The non-slip coating can be an additional layer of material attached to the rigid element 26, that is to say on the plate.

In this case, the additional material may comprise roughnesses and/or an adhesive coating such as glue.

Of course, in the case where an adhesive coating is used, the latter is selected so as to be compatible with the reusable nature of the package 1.

In other words, the adhesive coating should be able to improve the retention of an object O to be transported in the package 1, while having the ability to be separated from the object O to be transported when a user desires to extract it from the package 1.

The additional material can in particular be a leather or a synthetic material which has features allowing it to adhere to the objects O to be transported contained in the case 2.

However, to maintain the reusable nature of the package 1, it is essential that the additional layer of material does not allow dirt such as dust, sand or other elements that would prevent the adhesion of the object O to be transported on the rigid element 26, that is to say the plate. In the case of a flexible material, a foam can be used. This foam must in particular allow to be deformed in order to best match the contours of the object O to be transported, or of the objects O to be transported.

Furthermore, the package 1, and more particularly the case 2, comprises a digital communication panel 28 secured to one of the panels 221, 222, 223, 224 of the peripheral rim 22 of the case 2. If applicable, the digital panel 28 can be secured to the cover 3.

As illustrated in FIG. 1 in particular, the digital communication panel 28 is secured to the first panel 221 of the peripheral rim 22.

This digital communication panel allows in particular to display, via a screen 281, information related to the transport of the package 1, for example the destination, or a signal, such as a bar code, intended to be read by operators of a supply chain, generally a logistics chain.

Figure 6:
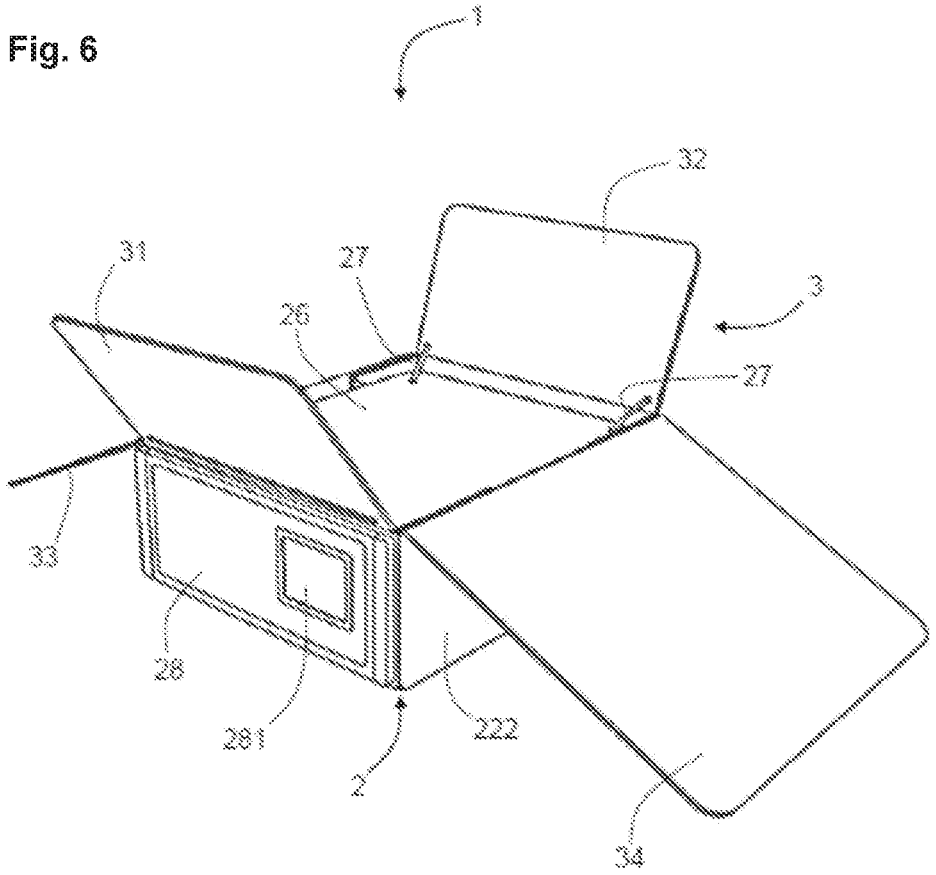
FIG. 6 is a perspective top view of the package according to the invention, prior to the insertion of an object into the package.
Figure 7:
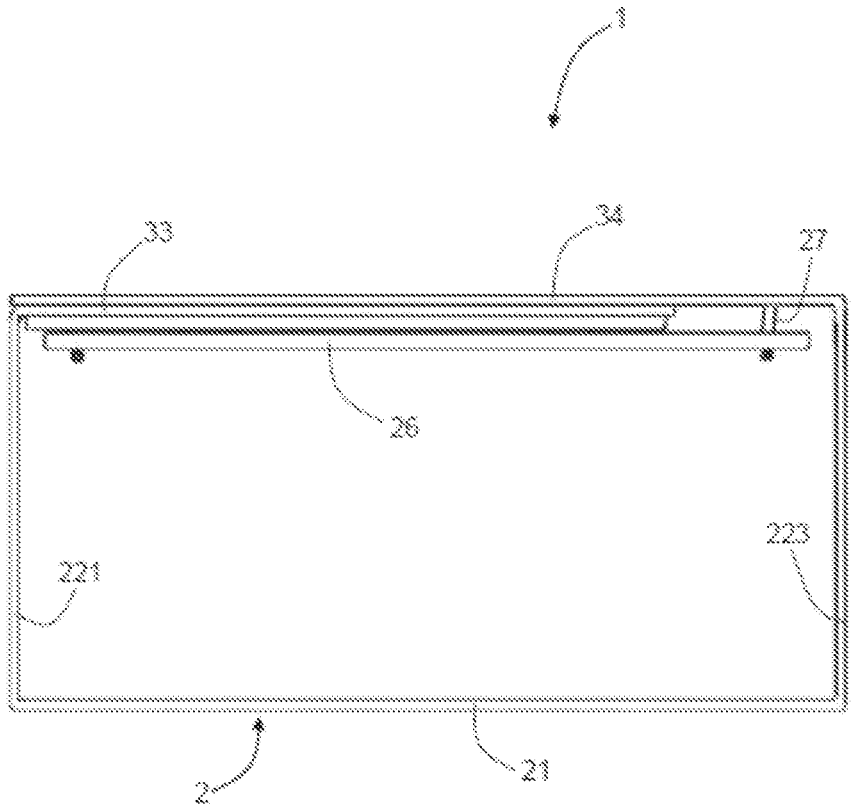
FIG. 7 is a longitudinal sectional view of the package according to the invention as illustrated in FIG. 6.

As illustrated in FIGS. 2 and 6 in particular, the cover 3 comprises:

a first flap 31 rotatably mounted on the first panel 221 of the peripheral rim 22;

a second flap 32 rotatably mounted on the third panel 223 of the peripheral rim 22;

a third flap 33 rotatably mounted on the second panel 222 of the peripheral rim 22;

a fourth flap 34 rotatably mounted on the fourth panel 224 of the peripheral rim 22.

In other words, each of the first panel 221, the second panel 222, the third panel 223 and the fourth panel 224 of the peripheral rim 22 is interposed between the bottom 21 and the cover 3. Each flap 31, 32, 33, 34 is thus movable between a closed position in which it prevents access to the stowing volume of the case 22, and an open position in which it leaves free access to the stowing volume of the case 22.

The various flaps 31, 32, 33, 34 of the cover 3 are intended, when the case 2 is shaped as illustrated in FIG. 1, either to be opposite one another in pairs, or to overlap one another.

More specifically, when the case 2 is shaped, the first flap 31 and the second flap 32 of the cover 3 extend in the continuation of one another, and the third flap 33 and the fourth flap 34 of the cover 3 extend overlapping one another and overlapping the first flap 31 and the second flap 32.

In other words, the first flap 31 and the second flap 32 face the stowing volume, and more specifically the rigid element 26, that is to say the plate, and are interposed between the third flap 33 and the fourth flap 34 on the one hand, and the rigid element 26, that is to say the plate, on the other hand.

Advantageously, the first flap 31 and the second flap 32 each have an internal surface covered with a flexible material and/or a non-slip coating, for holding in position at least one object O to be transported in the package 1, as explained below.

The non-slip coating can be an additional layer of material attached to the rigid element 26, that is to say on the plate.

In this case, the additional material may comprise roughnesses and/or an adhesive coating such as glue.

Of course, in the case where an adhesive coating is used, the latter is selected so as to be compatible with the reusable nature of the package 1.

In other words, the adhesive coating should be able to improve the retention of an object O to be transported in the package 1, while having the ability to be separated from the object O to be transported when a user desires to extract it from the package 1.

The additional material can in particular be a leather or a synthetic material which has features allowing it to adhere to the objects O to be transported contained in the case 2.

However, to maintain the reusable nature of the package, it is essential that the additional layer of material does not allow dirt such as dust, sand or other elements that would prevent the adhesion of the object O to be transported against the cover 3.

In the case of a flexible material, a foam can be used. This foam must in particular allow to be deformed in order to best match the contours of the object O to be transported, or of the objects O to be transported.

Figure 12:
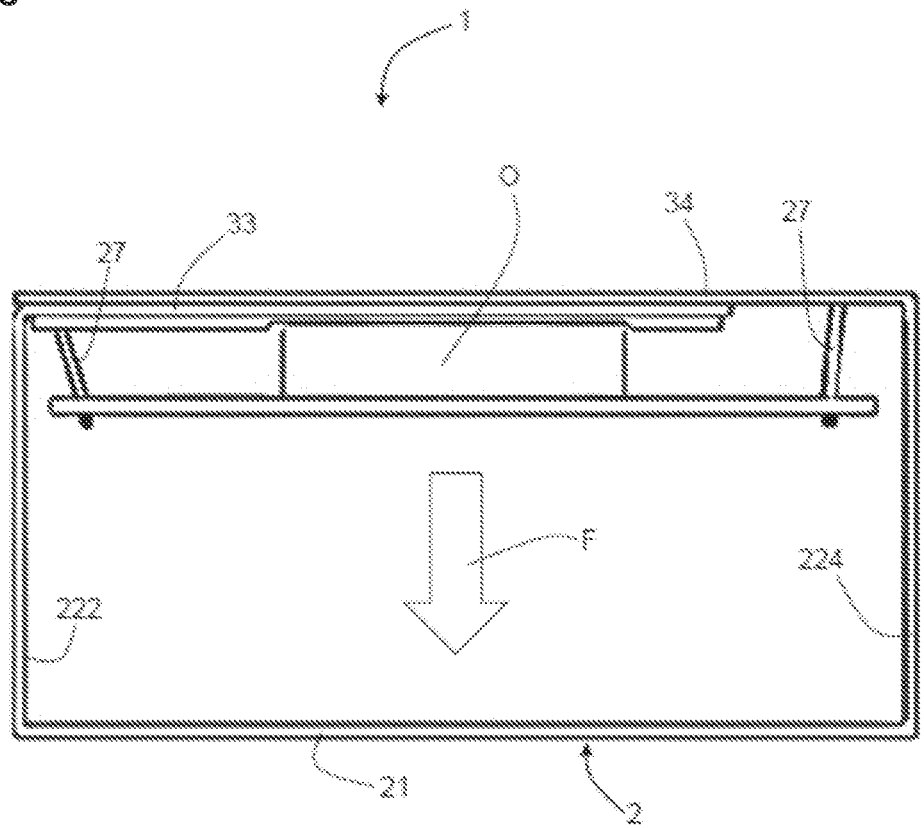
FIG. 12 is a longitudinal sectional view of a package according to the invention in a use configuration.

According to the embodiment illustrated in FIG. 12, the rigid element 26, that is to say the plate, carries a non-slip coating, and the cover 3 carries a flexible material, for example foam. According to a variant embodiment not shown, it is the third flap 33 and the fourth flap 34 which extend in the continuation of one another, and the first flap 31 and the second flap 32 of the cover 3 extending overlapping one another and overlapping the third flap 33 and the fourth flap 34 of the cover 3. In this variant embodiment, the flexible material and/or the non-slip coating is then carried by the third flap 33 and the fourth flap 34.

Referring to FIG. 12, which shows in longitudinal section the package 1, only one of the third flap 33 and the fourth flap 34 carries a deformed foam in contact with the object O to be transported, the fourth flap 34 overlapping the first flap 31. In this configuration, the plate, that is to say the rigid element 26, is connected to the third flap 33 and to the fourth flap 34 of the cover 3 by the elastic connection 27.

To allow safe transport of an object O, a package 1 according to the invention can be used. For this purpose, the package 1, initially in a folded configuration to be stored, must be shaped in order to define the stowing volume.

Figure 3:
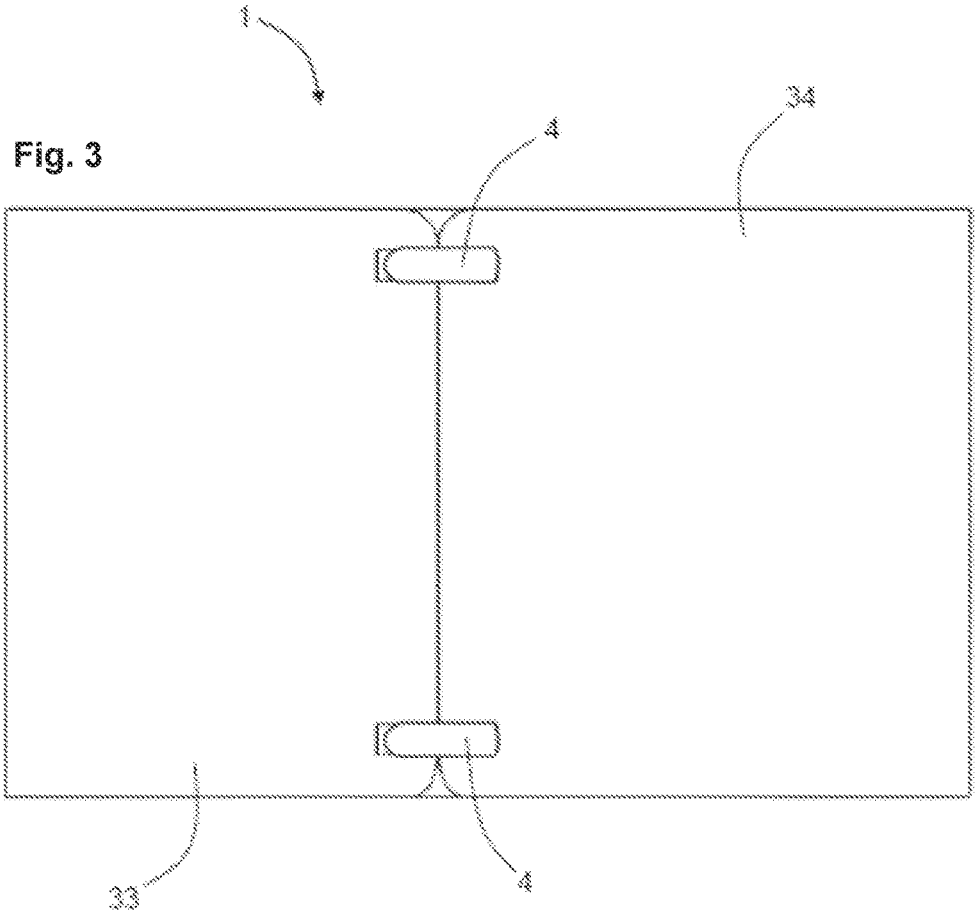
FIG. 3 is a top view of a package according to the invention, in a storage configuration.
Figure 4:
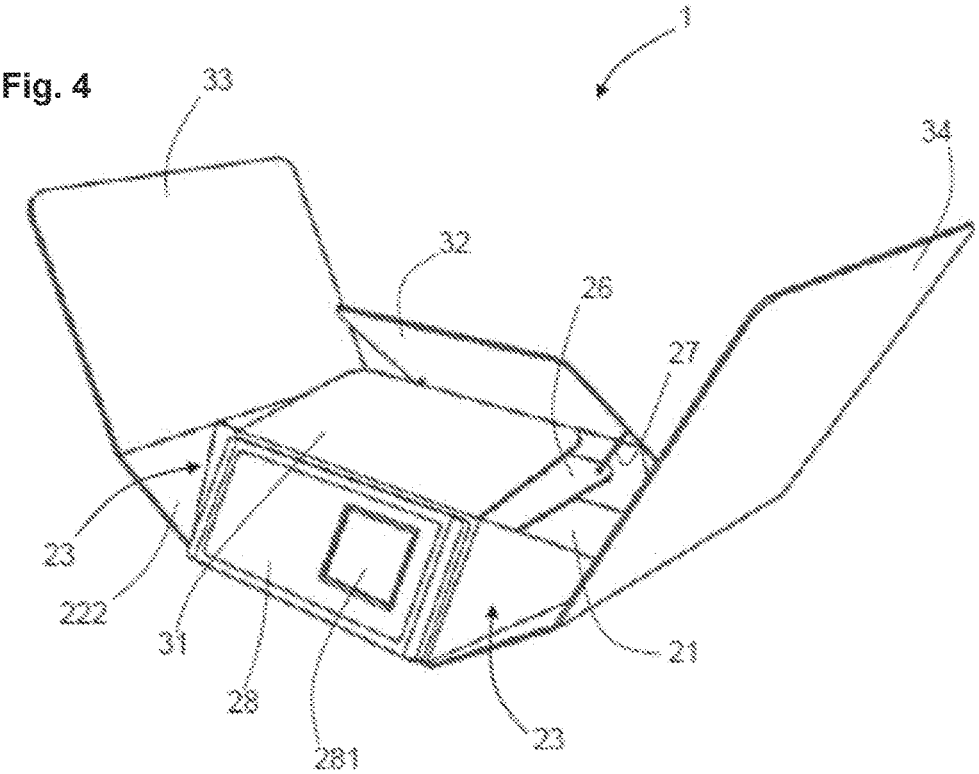
FIG. 4 is a perspective top view of the package according to the invention according to a step of shaping the package.
Figure 5:
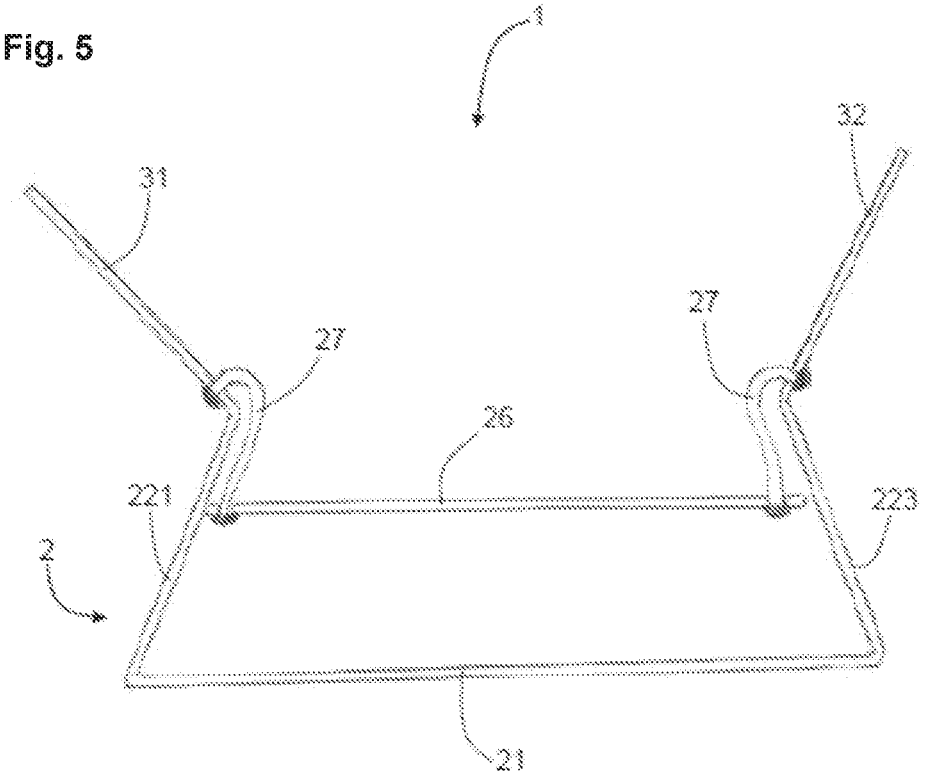
FIG. 5 is a longitudinal sectional view of the package according to the invention as illustrated in FIG. 4.

In its folded configuration, as illustrated in FIG. 3, the panels 221, 222, 223, 224 of the peripheral rim are in their stowed position, and the two parts of the drive elements 23 are folded over one another.

More specifically, the first panel 221 and the third panel 223 of the peripheral rim 22 extending overlapping the bottom 21 of the case 2, and the second panel 222 and the fourth panel 224 of the peripheral rim 22 extend in the continuation of the bottom 21 of the case 2.

In this stowing configuration, the flaps 31, 32, 33, 34 of the cover are positioned as follows:

the first flap 31 and the second flap 32 of the cover 3 each extend respectively in the continuation of the first panel 221 and the third panel 223 of the peripheral rim 22 and are positioned overlapping one another;

the third flap 33 and the fourth flap 34 extend respectively overlapping the second panel 222 and the fourth panel 224 of the peripheral rim 22, and extend substantially in the continuation of one another.

The plate is, in turn, in its storage position, that is to say, it is located near the bottom 21 of case 2.

Means 4 for holding the package 1 in the folded position can be disposed on the third flap 33 and the fourth flap 34 of the cover 3, these holding means 4 in the folded position being able, for example, to be in the shape of a mechanical adhesive. These holding means allow in particular to prevent unwanted shaping of the case 2.

Thus, in this stowing configuration, the package 1 has a small thickness compared to the thickness that it has during its use.

To shape the case 2 and therefore the package 1, the user acts on the third flap 33 and the fourth flap 34 of the cover to pivot them and have access to the first panel 221 and to the third panel 223 of the peripheral rim 22.

The user then grasps the first panel 221 and the third panel 223 of the peripheral rim 22 to position them in their use position by exerting a traction towards the outside of the case 2, that is to say to the opposite of the bottom 21.

During this movement, the drive elements 23 act by means of traction and exert a displacement movement of the second panel 222 and the fourth panel 224 of the peripheral rim 22 to position them in their use position.

More specifically, the first portion and the second portion of the drive elements 23 rotate relative to each other thanks to the hinge.

Thus, the first part, which is secured to the first panel 221 or the third panel 223 of the peripheral rim 22, transmits, via the hinge, its action to the second part of the drive elements 23 which is itself fixed or secured to the second panel 222 or to the fourth panel 224 of the peripheral rim 22, which causes the displacement of the second panel 222 and of the fourth panel 224 from the peripheral rim 22.

When the case 2 is shaped, that is to say that each of the first panel 221, the second panel 222, the third panel 223 and the fourth panel 224 of the peripheral rim 22 is in its use position, the retaining means 25 are operated to block the panels 221, 222, 223, 224 in their use position. More particularly, the first part of the retaining means 25, secured to the second panel 222 or the fourth panel 224 of the peripheral rim 22 cooperates with the first part of the retaining means 25, secured to the first part of each of the drive elements 23.

The passage of the first panel 221 and the third panel 223 from their stowed position to their use position is facilitated by the elastic connection 27.

Indeed, the tension in the elastic connection 27 which connects the rigid element 26, that is to say the plate, to the first panel 221 and to the third panel 223 of the peripheral rim 22, or to the cover 3, causes it to be spaced from the bottom 21 of the case. The rigid element 26 then rubs against the first panel 221 and the third panel 223 and causes the first panel 221 to be automatically spaced from the third panel 223. Thus, this limits the force required from the user. Once the case 2 has been shaped, the user can position an object O to be transported on the platform, that is to say on the rigid element 26.

The user can then position the lower face and in particular the flexible material secured to the third flap 33 and the fourth flap 34 of the cover 3, opposite the plate, that is to say against the object O to be transported. In the embodiment of FIG. 12, only the third flap 33 carries the flexible material, the latter thus being deformed in contact with the object O to be transported. As seen in FIG. 12, the object O is suitably held between the third flap 33 and the plate, that is to say the rigid element 26. The object O can thus no longer displace in the stowing volume of the package 1. This holding in position is in particular increased by the presence of the non-slip coating on the plate, that is to say on the rigid element 16.

Still as illustrated in FIG. 12, the elastic connection 27 is slightly tensioned, that is to say that the rigid element 26, and more particularly the elastic member, are in a constrained position. In other words, the elastic connection 27 tends to return the plate to the cover 3, thus forcing the contact of the object O on the flexible material, which also prevents the displacement of the object O by friction in particular.

The user can then fold the second flap 32 then the first flap 31 over the third flap 33 and the fourth flap 34, so as to permanently close the package 1.

Ad hoc means for holding the first flap 31 on at least one of the panels 221, 222, 223, 224 of the peripheral rim 22, for example on the second panel 222 and/or on the third panel 223 and/or on the fourth panel 224 of the peripheral rim 22 may in particular be provided.

The package 1 thus closed can then be routed via a current distribution network and the routing data can be loaded and displayed on the digital communication panel 28.

Advantageously, the package 1, in particular its case 2 and its cover 3, can in particular be produced from extruded polypropylene, such as the trade names Akylux®, Akyplein® and Akyboard® from the manufacturer DS SMITH, or from expanded polypropylene, that is to say in the form of a foam, as sold by the company Storopack.

The invention claimed is:

1. A package comprising a case defining a stowing volume, and a cover intended to close the stowing volume of the case, the case having a bottom and a peripheral rim comprising:

a first panel;

a second panel;

a third panel opposite the first panel;

a fourth panel opposite the second panel, the first panel, the second panel, the third panel and the fourth panel can adopt:

a stowed position in which each of the panels extends substantially parallel to the bottom;

a use position in which each of the panels extends substantially perpendicular to the bottom;

wherein the case comprises a rigid element connected to the first panel and to the third panel by an elastic connection, the rigid element being movable between:

a storage position of the case corresponding to the stowed position of the panels of the peripheral rim, in which the rigid element is located near the bottom;

a use position of the case corresponding to the use position of the panels of the peripheral rim, in which the rigid element is spaced from the bottom, the elastic connection tending to displace the rigid element from its storage position to its use position.

2. The package according to claim 1, wherein the case also comprises at least:

a first drive element interposed between the first panel and the second panel or the fourth panel of the peripheral rim;

a second drive element interposed between the third panel and the second panel or the fourth panel of the peripheral rim.

3. The package according to claim 1, wherein the rigid element is a plate of a length equal to the distance between the first panel and the third panel in their use position.

4. The package according to claim 3, wherein the plate carries a non-slip coating and/or a flexible material allowing the retention of an object in the stowing volume of the case.

5. The package according to claim 1, wherein the elastic connection comprises at least one elastically deformable band or cable.

6. The package according to claim 1, wherein the case also comprises means for retaining the first panel, the second panel, the third panel and the fourth panel in their use position.

7. The package according to claim 6, wherein the retaining means comprise two parts each permanently mounted on the peripheral rim of the case.

8. The package according to claim 1, wherein the cover comprises:

a first flap pivotally mounted on the first panel of the peripheral rim;

a second flap pivotally mounted on the third panel of the peripheral rim;

a third flap pivotally mounted on the second panel of the peripheral rim;

a fourth flap pivotally mounted on the fourth panel of the peripheral rim, each flap being movable between a closed position in which it prevents access to the stowing volume of the case, and an open position in which it leaves free access to the stowing volume of the case.

9. The package according to claim 8, wherein, in their closed position, the first flap and the second flap extend in the continuation of one another, and, the third flap and the fourth flap extend overlapping one another and overlapping the first flap and the second flap.

10. The package according to claim 8, wherein, in their closed position, the third flap and the fourth flap extend in the continuation of one another, and, the first flap and the second flap extend overlapping one another and overlapping the third flap and the fourth flap.

11. The package according to claim 8, wherein the first flap and the second flap, or the third flap and the fourth flap, which are in line, each have an internal surface facing the stowing volume in their closed position, the internal surface being covered with a non-slip coating and/or a flexible material capable of being deformed by an object contained in the stowing volume.

12. The package according to claim 1, wherein the package comprises a digital communication panel secured to one of the first panel, the second panel, the third panel or the fourth panel of the peripheral edge of the case, or to the cover.

* * * * *